United States Patent [19]

Meekins

[11] 3,934,165

[45] Jan. 20, 1976

[54] PROPORTIONAL COUNTER END EFFECTS ELIMINATOR

[75] Inventor: John F. Meekins, Springfield, Va.

[73] Assignee: The United States of America as represented by the Secretary of the Navy, Washington, D.C.

[22] Filed: Oct. 25, 1974

[21] Appl. No.: 518,115

[52] U.S. Cl. ..... 313/93; 250/374

[51] Int. Cl.[2] ..... H01J 39/26; H01J 39/29

[58] Field of Search ..... 313/93 UJ, 93 X, 93; 250/374 UJ

[56] References Cited

UNITED STATES PATENTS

| | | | |
|---|---|---|---|
| 2,837,678 | 6/1958 | Hendee et al. | 313/93 |
| 2,981,857 | 4/1961 | Wilson | 313/93 X |
| 3,348,090 | 10/1967 | Taylor | 313/93 |
| 3,430,087 | 2/1969 | Taylor | 313/93 |

*Primary Examiner*—Robert Segal

*Attorney, Agent, or Firm*—R. S. Sciascia; Arthur L. Branning; M. L. Crane

[57] ABSTRACT

An improved gas-filled proportional counter which includes a resistor network connected between the anode and cathode at the ends of the counter in order to eliminate "end effects".

3 Claims, 2 Drawing Figures

PROPORTIONAL COUNTER END EFFECTS ELIMINATOR

BACKGROUND OF THE INVENTION

This invention relates to gas-filled proportional counters and more particularly to a construction which eliminates end effects.

In general, conventional proportional counters comprise two electrodes in a surrounding of a desired gas at a desired pressure. Radiation entering the proportional counter ionizes the gas molecules therein to produce ions. The negatively charged ions produced will travel to the anode whereas the positively charged ions travel in the opposite direction to the cathode. The resulting output of the counter is a measure of the energy of the ionizing radiation which enters into the ionization chamber.

It is well known in the art that proportional counters produce electrical pulses in response to the absorption of a photon. When photons are absorbed near the ends of gas-filled proportional counters, the pulse amplitudes produced are less than if absorption had taken place in the middle of the counter. Conventionally, the ends of the proportional counter are not used, i.e., masks are placed so that no photon absorption occurs near the ends. Therefore a potentially useful part of the prior art counters are not being utilized. This may be a serious disadvantage whenever weight and volume are important.

SUMMARY OF THE INVENTION

This invention overcomes the disadvantages of the prior art by inserting a resistor-conductor network at the ends of the counter structure, thereby defining the mathematical boundary conditions there. In particular, the resistor-conductor network can be designed in such a way that the potential at the ends duplicates the potential on an infinitely long counter of similar cross section. By so defining the potential at the ends, the potential everywhere inside the counter becomes that of an infinitely long counter, i.e., eliminating end effects.

DETAILED DESCRIPTION OF THE DRAWING

Figure 1:
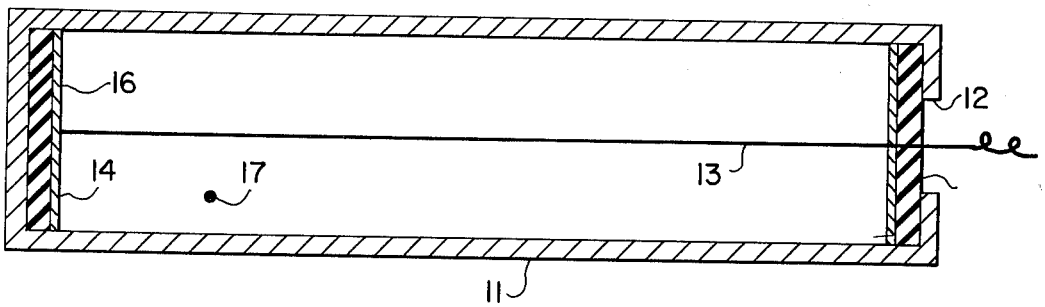
FIG. 1 is a cross sectional view illustrating the relative parts.

Now referring to the drawing, there is shown by illustration proportional counter including cylindrical metallic housing 11 such as stainless steel or any other suitable metal with an open end 12. The cylindrical housing forms the cathode which surrounds an axially disposed wire or rod anode 13. The anode wire is secured to an insulator disk 14 at each end passing through the insulator disk at the open end. The insulator disks may be made of alumina, mica or any other suitable insulator material and the disk is sealed to the open end of the housing to provide a gas tight chamber. A resistor network 16 in the form of a printed circuit is applied onto each of the insulator disk or deposited by other means thereon. The resistor is connected at one end to the anode and secured at the opposite end to the cathode housing. The counter is filled by known means not shown with a suitable gas at a suitable pressure.

Figure 2:
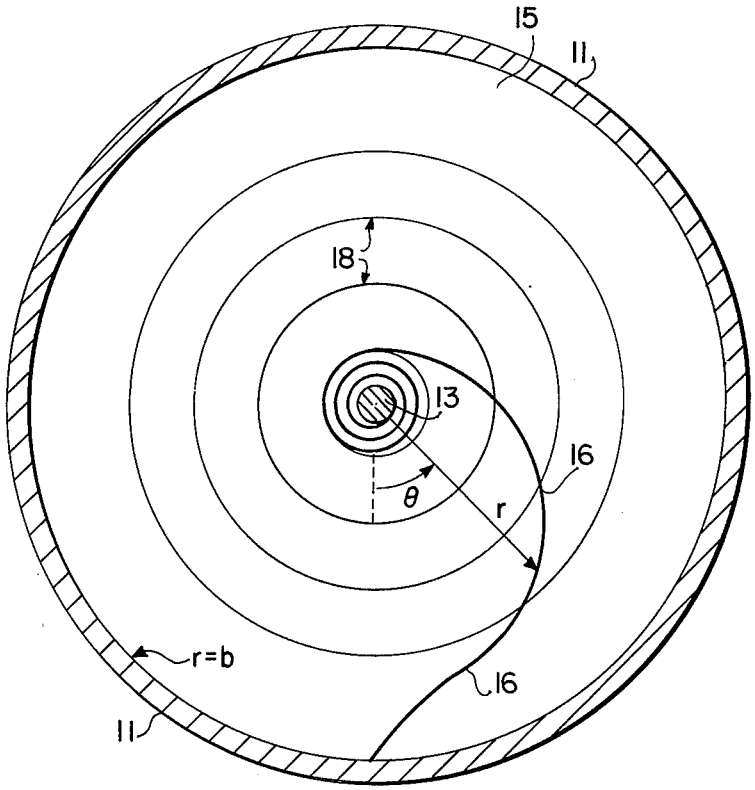
FIG. 2 illustrates an end view of the resistor-conductor network on the inside-end of the tube.

The resistor added to the end insulator material may be in the form of a solid thin layer of the same cross section as the counter as shown in FIG. 1 or other arrangement such as the network shown in FIG. 2 for a counter of circular cross section. A modification of the resistor arrangement 16 might, as shown in FIG. 2, then include spaced concentric rings 18 of conductive material, each ring having a greater diameter, upon which the resistor material is secured in order to define the field completely around the anode. This will result in much higher resistances between the anode and cathode than the solid thin layer. In the network shown in FIG. 2., the spiral resistor element is deposited between the anode and cathode and obeys the formula $$\theta = \sqrt{\left(\frac{b}{r}\right)^2 - 1} - \mathrm{Cos}^{-1}\left(\frac{r}{b}\right)$$

where $b$ is the inner radius of the counter body, $r$ is the radial distance from the center of the anode and $\theta$ is the angle in radians. Such a network will duplicate the potential of an infinitely long counter of circular cross-section along the resistor.

The total resistance with concentric rings of conductive material deposited onto the end insulator with the spiral of resistance material contacting the concentric rings will reproduce the potential on an infinitely long counter. In this case, the total resistance is a factor 2 $\pi$ b/g larger than the solid thin layer, where $g$ is the width of the resistor element. The requirement on the resistor network is $$\frac{\phi(\overline{X})}{V} = \frac{1}{R_t} \int \frac{\rho\, dl\, (\overline{X})}{t\, W(X)}$$

where $\phi(\overline{X})$ is the potential of the infinitely long counter of similar cross-section (a function of position), V is a potential between the anode and cathode, $\rho$ is the resistivity of the material (ohm-cm), (t is the thickness which may vary), $W(\overline{X})$ is the width of the material deposited, and dl is the distance along the resistor material. The total resistance, $R_t$, between anode and cathode is just this integral over the total length of material. Thick or thin film microcircuitry can be used to produce such resistor networks, yielding total resistances of 300 M ohm or more. Such resistances are well known in the art.

Except in the solid thin layer, it is necessary to deposite conductors along potential contours to define the field completely around the anode.

By inserting a resistor network at the ends of the counter, a potential can be established there between the anode and cathode which duplicates the potential of an infinitely long counter of similar cross-section. Thus, the potential produced every where in the counter will be the same as that of an infinitely long counter.

Thus, the improved proportional counter will avoid end effects normally found in the prior art proportional counters.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. An improved proportional counter including a gas filled cathode housing with a coaxially disposed anode and an insulator substrate at each end of said housing, the improvement comprising;

a resistor conductor network of resistive material deposited upon said substrate at each end of said counter on the inner surface of each of said substrates with the ends of said resistive material secured electrically to the cathode and anode, where the resistor-conductor network obeys the formula $$\theta = \sqrt{\left(\frac{b}{r}\right)^2 - 1 - \mathrm{Cos}^{-1}\left(\frac{r}{b}\right)}$$

where b is the inner radius of the counter body, r is the radial distance from the center of the anode, and $\theta$ is the angle in radians.

2. An improved proportional counter as claimed in claim 1; in which, said resistor material is in the form of a spiral with the resistor ends connected between said anode and said cathode.

3. An improved proportional counter as claimed in claim 1; which includes, a plurality of electrically conductive concentric rings deposited on said substrates and electrically connected to said resistor material.

* * * * *

UNITED STATES PATENT OFFICE

CERTIFICATE OF CORRECTION

PATENT NO. : 3,934,165

DATED : January 20, 1976

INVENTOR(S) : John F. Meekins

It is certified that error appears in the above-identified patent and that said Letters Patent are hereby corrected as shown below:

In the Claims:

Claim 1, line 15,

"$\theta = \sqrt{(\frac{b}{r})^2 - 1} - \mathrm{Cos}^{-1}(\frac{r}{b})$" should read $\theta = \sqrt{(\frac{b}{r})^2 - 1} - \mathrm{Cos}^{-1}(\frac{r}{b})$ .

Signed and Sealed this

Seventeenth Day of August 1976

[SEAL]

*Attest:*

RUTH C. MASON
*Attesting Officer*

C. MARSHALL DANN
*Commissioner of Patents and Trademarks*